US008555829B2

(12) United States Patent
Lee et al.

(10) Patent No.: US 8,555,829 B2
(45) Date of Patent: Oct. 15, 2013

(54) VARIABLE COMPRESSION RATIO APPARATUS

(75) Inventors: Dong Seok Lee, Whasung-Si (KR); Jei Choon Yang, Whasung-Si (KR); Chang Ho Yang, Whasung-Si (KR); Eun Ho Lee, Whasung-Si (KR); Yoonsik Woo, Whasung-Si (KR); Jin Kook Kong, Whasung-Si (KR); Soo Hyung Woo, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 284 days.

(21) Appl. No.: 13/182,898

(22) Filed: Jul. 14, 2011

(65) Prior Publication Data

US 2012/0125297 A1 May 24, 2012

(30) Foreign Application Priority Data

Nov. 18, 2010 (KR) ..... 10-2010-0115240

(51) Int. Cl.
*F02B 75/04* (2006.01)

(52) U.S. Cl.
USPC ..... 123/48 B; 123/78 B

(58) Field of Classification Search
USPC ..... 123/48 R, 48 B, 78 R, 78 B, 78 BA, 78 E
See application file for complete search history.

(56) References Cited

U.S. PATENT DOCUMENTS 2,029,169 A * 1/1936 Hironaka ..... 123/48 B
4,131,094 A * 12/1978 Crise ..... 123/48 B

FOREIGN PATENT DOCUMENTS

JP 4405361 B2 11/2009

* cited by examiner

*Primary Examiner* — Noah Kamen
(74) *Attorney, Agent, or Firm* — Morgan, Lewis & Bockius LLP

(57) ABSTRACT

A variable compression ratio apparatus for an engine receiving combustion force of an air-fuel mixture from a piston and rotating a crankshaft, and for changing compression ratio of the air-fuel mixture. The apparatus may include a connecting rod including one end with a mounting hole and an other end eccentrically and rotatably connected to the crankshaft, an eccentric link including one end connected to an eccentric bearing concentrically and rotatably mounted in the mounting hole, a piston pin eccentrically and rotatably mounted in the eccentric bearing, a variable link including one end rotatably connected to an other end of the eccentric link, a variable gear link pivoting with respect to a fixed shaft and formed of first gear teeth at an exterior circumference, an external circumferential portion rotatably connected to an other end of the variable link, a control shaft including second gear teeth engaged to the first gear teeth and rotating to pivot the variable gear link, and a guide bar, together with the connecting rod, limiting horizontal movement of the eccentric link.

17 Claims, 6 Drawing Sheets

VARIABLE COMPRESSION RATIO APPARATUS

CROSS-REFERENCE TO RELATED APPLICATION

This application claims priority to and the benefit of Korean Patent Application No. 10-2010-0115240 filed Nov. 18, 2010, the entire contents of which application is incorporated herein for all purposes by this reference.

BACKGROUND OF INVENTION

1. Field of Invention

The present invention relates to a variable compression ratio apparatus. More particularly, the present invention relates to a variable compression ratio apparatus which changes compression ratio of an air-fuel mixture in a combustion chamber according to a driving condition of an engine.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

According to a conventional variable compression ratio apparatus, a variable compression ratio is achieved by changing a length of a connecting rod which connects a piston to a crankshaft. Such types of a variable compression ratio apparatus include a plurality of links connecting a piston with the crankshaft, and combustion force is directly transmitted to the links. So, durability of the links deteriorates.

It becomes known to a person skilled in the art through various experimental results conducted to a conventional variable compression ratio apparatus that operation reliability is high in a case that a distance between a crank pin and a piston pin is changed by using an eccentric bearing. If hydraulic pressure, however, is used for rotating the eccentric bearing, a rotating angle of the eccentric bearing in each cylinder or hydraulic pressure applied to each cylinder is different. So, a compression ratio in a cylinder is different from that in another cylinder and a time required for changing the compression ratio according to the driving condition of the engine is varied in each cylinder.

Since links for rotating the eccentric bearing can be escaped horizontally, additional devices for limiting movement trace of the links should be provided at the connecting rod or the links. Therefore, structures of the connecting rod or the links may become complex and moving mass may increase.

Meanwhile, many inventors have been developing that the movement trace of the links is limited by using balance weights provided at a crankshaft without change in a structure of the connecting rod or the links. In this case, length of the link may become longer such that a portion of the link is always positioned in movement trace of the balance weights, and size of the balance weights may become larger. In addition, a portion of the balance weights must be trimmed so as to prevent interference between movement traces of the links and the balance weights.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a variable compression ratio apparatus having advantages of changing compression ratio of an air-fuel mixture as a consequence of mounting an eccentric bearing in a small end portion of a connecting rod and rotating the eccentric bearing by using link members.

Various aspects of the present invention provide for minimizing combustion force of the air-fuel mixture transmitted to the link members by kinematically separating a connecting rod from the link members.

Various aspects of the present invention provide for liming movement traces of link members without increase in sizes of balance weights and the link members.

A variable compression ratio apparatus according an various aspects of the present invention is mounted at an engine receiving combustion force of an air-fuel mixture from a piston and rotating a crankshaft, and changes compression ratio of the air-fuel mixture. The variable compression ratio apparatus may include a connecting rod provided with one end formed of a mounting hole and the other end eccentrically and rotatably connected to the crankshaft, wherein a piston pin is inserted in the mounting hole and the one end of the connecting rod is rotatably connected to the piston through the piston pin, an eccentric link provided with one end to which an eccentric bearing concentrically and rotatably mounted in the mounting hole is connected and the other end, the piston pin being eccentrically and rotatably mounted in the eccentric bearing, a variable link provided with one end rotatably connected to the other end of the eccentric link and the other end, a variable gear link configured to pivot with respect to a fixed shaft and formed of a first gear teeth at an exterior circumference thereof, an external circumferential portion thereof being rotatably connected to the other end of the variable link, a control shaft formed of a second gear teeth engaged to the first gear teeth at an exterior circumference thereof and rotating so as to pivot the variable gear link, and a guide bar, together with the connecting rod, limiting horizontal movement of the eccentric link.

The pivoting movement of the variable gear link according to the rotation of the control shaft may rotate the eccentric link through the variable link.

The variable gear link may have fan shape, and the fixed shaft may be positioned near a vertex of the fan shape.

The variable gear link may be formed with a variable link slot, and the other end of the variable link may be inserted in the variable link slot such that horizontal movement of the variable link is limited.

The guide bar may be coupled to a lower end of a cylinder block liner or a bulk portion.

The guide bar may be disposed at an opposite side of the connecting rod with reference to the eccentric link.

A plurality of balance weights for reducing rotational vibration may be mounted at the crankshaft, and the connecting rod, the eccentric link, and the variable link may be disposed between a pair of balance weights.

The variable compression ratio apparatus may further include an actuator connected to the control shaft and adapted to rotate the control shaft A variable compression ratio apparatus according to other aspects of the present invention may include a connecting rod provided with one end formed of a mounting hole and the other end rotatably connected to the crankshaft so as to transmit the combustion force of the air-fuel mixture received from the piston to the crankshaft, a control shaft rotating according to a driving condition of the engine, a variable gear link pivoting with respect to a fixed shaft by the rotation of the control shaft, an eccentric link provided with one end connected to an eccentric bearing which is concentrically and rotatably mounted in the mounting hole, a variable link connecting the other end of the eccentric link to the variable gear link and rotating the eccentric link with respect to the eccentric bearing by pivoting movement of the variable gear link, a piston pin eccentrically inserted in the eccentric bearing and mounted in the piston so as to rotatably connect the eccentric link and the connecting rod to the piston, and a guide bar, together with the connecting rod, limiting horizontal movement of the eccentric link.

The variable gear link may have fan shape, and the fixed shaft may be positioned near a vertex of the fan shape.

A first gear teeth may be formed at an exterior circumference of the variable gear link, and a second gear teeth engaging with the first gear teeth may be formed at an exterior circumference of the control shaft.

The variable gear link may be formed with a variable link slot, and the other end of the variable link may be inserted in the variable link slot such that horizontal movement of the variable link is limited.

The guide bar may be coupled to a lower end of a cylinder block liner or a bulk portion.

The guide bar may be disposed at an opposite side of the connecting rod with reference to the eccentric link.

A plurality of balance weights for reducing rotational vibration may be mounted at the crankshaft, and the connecting rod, the eccentric link, the variable link, and the variable gear link may be disposed between a pair of balance weights.

A plurality of balance weights for reducing rotational vibration may be mounted at the crankshaft, and the connecting rod, the eccentric link, and the variable link may be disposed between a pair of balance weights.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
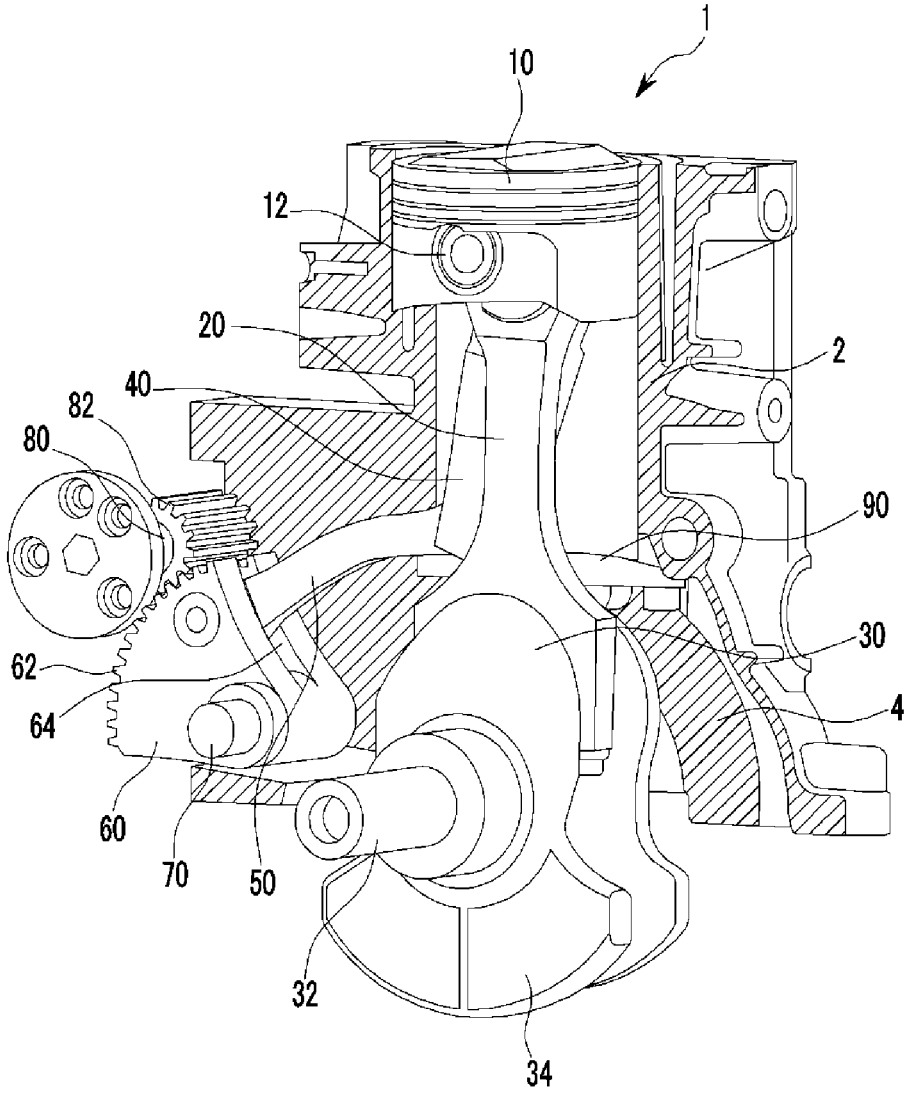
FIG. 1 is a perspective view of an exemplary variable compression ratio apparatus according to the present invention.
Figure 2:
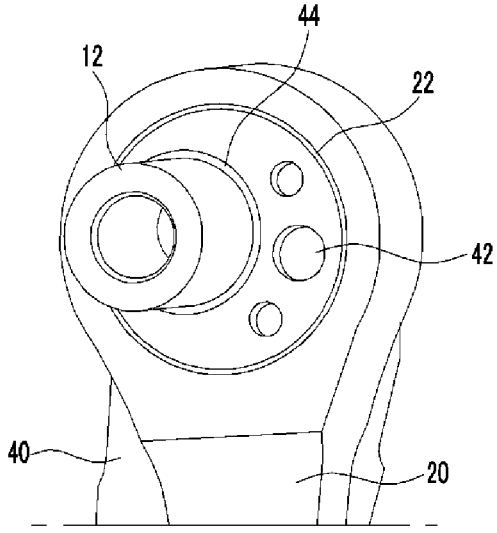
FIG. 2 is a schematic diagram illustrating connection between an eccentric bearing and a connecting rod in an exemplary variable compression ratio apparatus according to the present invention.
Figure 3:
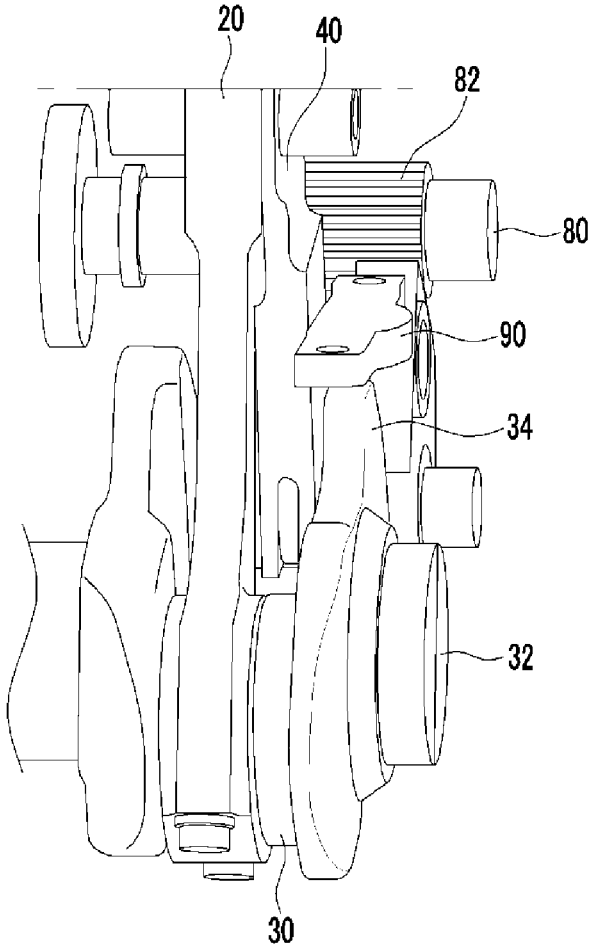
FIG. 3 is a front view illustrating a lower portion of an exemplary variable compression ratio apparatus according to the present invention.

As shown in FIG. 1 to FIG. 3, a variable compression ratio apparatus 1 according to various embodiments of the present invention is mounted at an engine which receives combustion force of an air-fuel mixture from a piston 10 and rotates a crankshaft 30. The variable compression ratio apparatus changes compression ratio of the air-fuel mixture according to a driving condition of the engine.

The engine is provided with a cylinder block liner 2 and a crank web 4, and the crank web 4 is coupled to a lower portion of the cylinder block liner 2.

The piston 10 is mounted in the cylinder block liner 2 and moves vertically in the cylinder block liner 2 by the combustion force of the air-fuel mixture. A combustion chamber is formed between the piston 10 ad a cylinder, and the air-fuel mixture flows in the combustion chamber and is burned therein.

The crankshaft 30 receives the combustion force from the piston 10 and transmits torque to a transmission after converting the combustion force into the torque. The crankshaft 30 is mounted in the crank web 4. The crankshaft 30 includes a crank pin 32 formed eccentrically to the crankshaft 30. In addition, a plurality of balance weights 34 is mounted at the crankshaft 30. Such the balance weight 34 reduces rotational vibration generated when the crankshaft 30 rotates.

The variable compression ratio apparatus 1 includes a connecting rod 20, an eccentric link 40, a variable link 50, a variable gear link 60, a control shaft 80, and a guide bar 90.

The connecting rod 20 receives the combustion force from the piston 10 and transmits the combustion force to the crankshaft 30. The connecting rod 20 is similar to a conventional connecting rod. For this purpose, one end of the connecting rod 20 is rotatably connected to the piston 10 through a piston pin 12, and the other end of the connecting rod 20 is eccentrically and rotatably connected to the crankshaft 30. Generally, the one end of the connecting rod 20 connected to the piston 10 is called a small end, and the other end of the connecting rod 20 connected to the crankshaft 30 is called a big end. In addition, an eccentric bearing mounting hole 22 is concentrically formed at one end of the connecting rod 20 (i.e., small end). Since the connecting rod 20 similar to the conventional connecting rod is used, a structure of a conventional engine may not be changed so as to mount the variable compression ratio apparatus. In addition, durability of link members forming the variable compression ratio apparatus may be improved by transmitting the combustion force of the air-fuel mixture mostly to the connecting rod 20.

The eccentric link 40 has both ends, and one end of the eccentric bearing link 40 is rotatably connected to the one end of the connecting rod 20. For this purpose, an eccentric bearing 42 is connected to the one end of the eccentric link 40, and the eccentric bearing 42 is concentrically mounted in the eccentric bearing mounting hole 22. A pin mounting hole 44 is formed at the eccentric bearing 42. The pin mounting hole 44 is eccentric to the eccentric bearing 42. The piston pin 12 is inserted in the pin mounting hole 44 so as to rotatably connect the connecting rod 20 and the eccentric link 40 to the piston 10. That is, a central axis of the eccentric bearing 42, which is the same as a central axis of the eccentric bearing mounting hole 22, is parallel to the piston pin 12 and is disposed apart from the piston pin 12 by a predetermined distance. Therefore, if the eccentric bearing 42 rotates, a relative position of a center of the piston pin 12 to a center of the eccentric bearing mounting hole 22 changes, and thereby, a relative position of the piston pin 12 to a crank pin 32 changes. Therefore, the compression ratio of the air-fuel mixture is changed. One will appreciate that the eccentric bearing 42 may be integrally and/or monolithically formed with the eccentric link 40 (as shown), but the scope of the present invention is not limited to this. That is, the eccentric bearing 42 and the eccentric link 40 may be manufactured separately and then be assembled.

The variable link 50 rotates the eccentric link 40 with respect to the eccentric bearing 42. For this purpose, the variable link 50 is provided with both ends, and one end of the variable link 50 is rotatably connected to the other end of the eccentric link 40. It is exemplarily shown in this specification that one variable link 50 is used, but the scope of the present invention is not limited to this. That is, two or more variable links 50 can be used. In addition, the number of the variable link 50 may be the same that of the eccentric link 40 or not.

The variable gear link 60 has fan shape, and a fixed shaft 70 is mounted near a vertex of the fan shape. Therefore, the variable gear link 60 can pivot with respect to the fixed shaft 70. The pivoting movement of the variable gear link 60 rotates the eccentric link 40 with respect to the eccentric bearing 42 through the variable link 50. For this purpose, the other end of the variable link 50 is rotatably connected to an external circumferential portion of the variable gear link 60. In addition, a first gear teeth 62 is formed at an exterior circumference of the variable gear link 60. In addition, a variable link slot 64 is formed at the variable gear link 60, and the other end of the variable link 50 is inserted in the variable link slot 64. The variable link 50 is prevented from being escaped by the variable link slot 64 horizontally (to the front or rear in the drawing).

The control shaft 80 rotates according to the driving condition of the engine and pivots the variable gear link 60. For this purpose, a second gear teeth 82 engaged with the first gear teeth 62 of the variable gear link 60 is formed at an exterior circumference of the control shaft 80. In addition, the control shaft 80 is connected to an actuator such as an electric motor, a hydraulic motor, and electric, mechanical, or hydraulic means for rotating the control shaft 80 and an operation of the actuator is controlled by a control portion. Therefore, if the control portion decides the compression ratio of the air-fuel mixture according to the driving condition of the engine, the control portion operates the actuator. The control shaft 80 rotates by the operation of the actuator and changes the compression ratio of the air-fuel mixture.

The variable compression ratio apparatus according to various embodiments of the present invention operates independently from the rotation of the crankshaft 30. Therefore, the link members used in variable compression ratio apparatus may collides with the crankshaft 30. Particularly, a connecting portion of the eccentric link 40 and the variable link 50 have high possibility of colliding with the balance weight 34 of the crankshaft 30 considering a movement trace thereof. In addition, when the engine operates, the eccentric link 40 and the variable links 50 moves from side to side (horizontally) and may be disassembled. To solve such a problem, a guide bar 90 is coupled to a lower end of the cylinder block liner 2. In addition, the guide bar 90 is coupled to a bulk portion (positioned between the lower end of the cylinder block liner 2 and an upper end of the crank web 4). The guide bar 90 is formed to cross a bore of the cylinder block liner 2 and is mounted at an opposite side of the connecting rod 20 with respect to the eccentric link 40. In addition, a portion of the eccentric link 40 is adapted to be always disposed between the connecting rod 20 and the guide bar 90. Furthermore, the connecting rod 20, the eccentric link 40, and the variable link 50 can be disposed between a pair of balance weights 34. When the piston 10 is positioned near a top dead center (TDC), a lower portion of the eccentric link 40 is restricted by the connecting rod 20 and the guide bar 90 such that horizontal escape of the eccentric link 40 can be prevented. If the piston 10 is positioned near a bottom dead center (BDC), an upper portion of the eccentric link 40 is restricted by the connecting rod 20 and the guide bar 90 and the lower portion of the eccentric link 40 is restricted by the connecting rod 20 and the balance weight 34 such that horizontal escape of the eccentric link 40 can be prevented.

According to a conventional art, the eccentric link 40 was restricted only by the balance weight 34 and the connecting rod 20. For this purpose, length of the eccentric link 40 was made longer and size of the balance weight 34 was enlarged so as to always dispose the portion of the eccentric link 40 between the balance weights 34. In this case, mass of the eccentric link 40 and the balance weight 34 increased and moving mass also increased. Therefore, size of the engine also increased. Since the guide bar 90 and the balance weight 34, however, restricts movement of the eccentric link 40, length of the eccentric link 40 and size of the balance weight 34 may not be increase according to various embodiments of the present invention. Therefore, moving mass may reduce and size of the engine may not increase. In addition, since the guide bar 90 is coupled to the lower end of the cylinder block liner 2, structure of the engine is hardly changed.

In addition, a specific portion of the balance weight 34 is trimmed so as to secure operating region of the variable compression ratio apparatus and to guide a connecting portion of the eccentric link 40 and the variable link 50. The specific portion can be easily set by a person skilled in the art considering a movement trace of the eccentric link 40 and the variable link 50 and a movement trace of corresponding balance weight 34.

Meanwhile, rotatable connection of the links means in this specification that the links are connected to each other though connecting means such as a pin and enable of relative rotation.

Hereinafter, operation of the variable compression ratio apparatus 1 according to various embodiments of the present invention will be described in detail with reference to FIG. 4 and FIG. 5.

Figure 4:
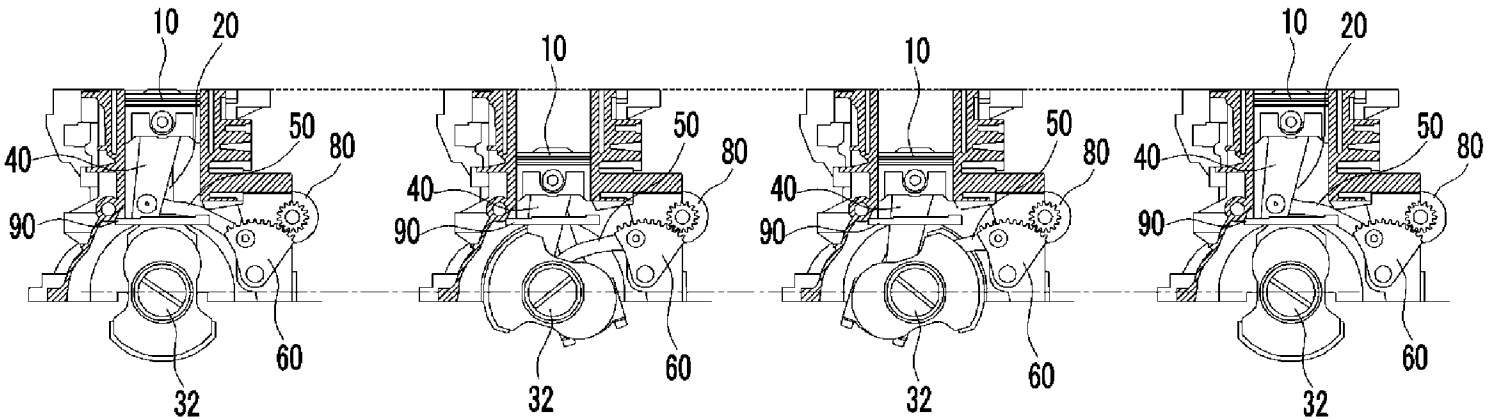
FIG. 4 is a schematic diagram illustrating an exemplary variable compression ratio apparatus according to the present invention operating at a low compression ratio.

As shown in FIG. 4, if the control shaft 80 rotates counterclockwise in a state that the variable compression ratio apparatus operates at a low compression ratio, the variable gear link 60 pivots clockwise and pulls the variable link 50. Accordingly, the eccentric link 40 rotates counterclockwise and a position of the piston pin 12 is heightened. Therefore, the distance between the piston pin 12 and the crank pin 32 becomes longer and a high compression ratio is achieved as shown in FIG. 5.

Figure 5:
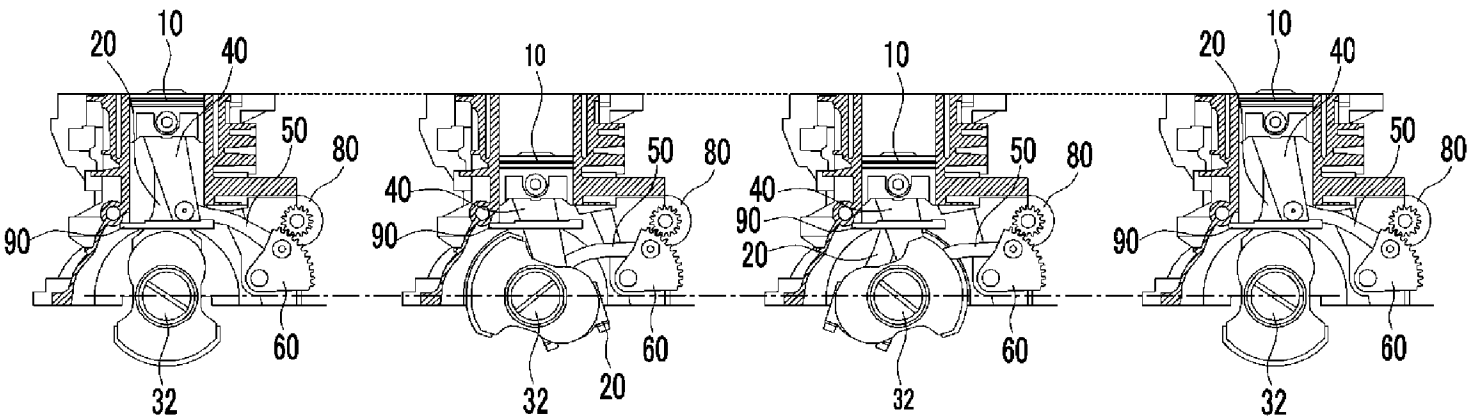
FIG. 5 is a schematic diagram illustrating an exemplary variable compression ratio apparatus according to the present invention operating at a high compression ratio.

As shown in FIG. 5, if the control shaft 80 rotates clockwise in a state that the variable compression ratio apparatus 1 operates at the high compression ratio, the variable gear link 60 pivots clockwise and pushes the variable links 50. Accordingly, the eccentric link 40 rotates clockwise and the position of the piston pin 12 is lowered. Therefore, the distance between the piston pin 12 and the crank pin 32 becomes shorter and the low compression ratio is achieved as shown in FIG. 4.

Figure 6:
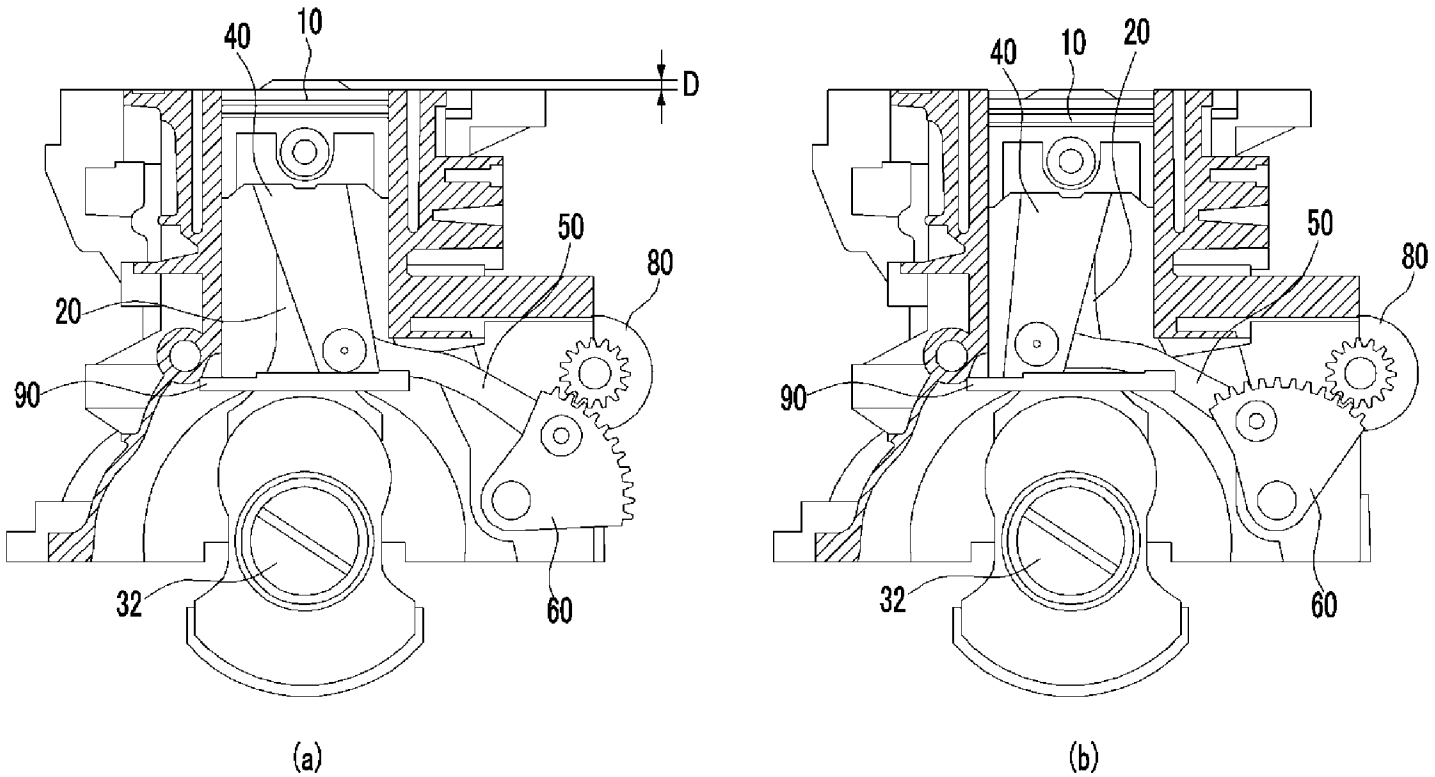
FIG. 6 is a schematic diagram illustrating an exemplary variable compression ratio apparatus according to the present invention operating at the low compression ratio and the high compression ratio.

With reference to FIG. 6, if the control shaft 80 rotates clockwise in a state that the variable compression ratio apparatus operates at the high compression ratio, the piston pin 12 is lowered by a predetermined height D by the variable gear link 60, the variable link 50, and the eccentric link 40. Accordingly, the low compression ratio is achieved.

On the contrary, if the control shaft 80 rotates counterclockwise in a state that the variable compression ratio apparatus operates at the low compression ratio, the piston pin 12 is heightened by the predetermined height D by the variable gear link 60, the variable link 50, and the eccentric link 40. Accordingly, the high compression ratio is achieved.

As described above, since a connecting rod similar to a conventional connecting rod is used according to the present invention, a variable compression ratio apparatus may be installed without change in a structure of a conventional engine.

In addition, durability of link members may be improved as a consequence of transmitting combustion force of an air-fuel mixture to the connecting rod directly.

In addition, since movement trace of the eccentric link is restricted by the guide bar and the balance weight, operating stability may be secured and length of the eccentric link and size of the balance weight may not increase. Therefore, moving mass may be reduced and installability may be improved.

Since the guide bar is mounted at a lower end of the cylinder block liner, structure of the cylinder block may be hardly changed. Therefore, the variable compression ratio apparatus may be easily mounted at a conventional engine.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus for an engine receiving combustion force of an air-fuel mixture from a piston and a rotating crankshaft, and which changes compression ratio of the air-fuel mixture, the variable compression ratio apparatus comprising:

a connecting rod including one end formed with a mounting hole and an other end eccentrically and rotatably connected to the crankshaft, wherein a piston pin is inserted in the mounting hole and the one end of the connecting rod is rotatably connected to the piston through the piston pin;

an eccentric link including one end connected to an eccentric bearing concentrically and rotatably mounted in the mounting hole and an other end, the piston pin being eccentrically and rotatably mounted in the eccentric bearing;

a variable link including one end rotatably connected to the other end of the eccentric link, and including an other end;

a variable gear link configured to pivot with respect to a fixed shaft and including a first gear teeth at an exterior circumference thereof, an external circumferential portion thereof being rotatably connected to the other end of the variable link;

a control shaft including a second gear teeth engaged to the first gear teeth at an exterior circumference thereof and rotating so as to pivot the variable gear link; and a guide bar, together with the connecting rod, limiting horizontal movement of the eccentric link.

2. The variable compression ratio apparatus of claim 1, wherein the pivoting movement of the variable gear link according to the rotation of the control shaft rotates the eccentric link through the variable link.

3. The variable compression ratio apparatus of claim 1, wherein the variable gear link has fan shape, and the fixed shaft is positioned near a vertex of the fan shape.

4. The variable compression ratio apparatus of claim 1, wherein the variable gear link is formed with a variable link slot, and the other end of the variable link is inserted in the variable link slot such that horizontal movement of the variable link is limited.

5. The variable compression ratio apparatus of claim 1, wherein the guide bar is coupled to a lower end of the cylinder block liner or a bulk portion.

6. The variable compression ratio apparatus of claim 5, wherein the guide bar is disposed at an opposite side of the connecting rod with reference to the eccentric link.

7. The variable compression ratio apparatus of claim 5, wherein a plurality of balance weights for reducing rotational vibration is mounted at the crankshaft, and the connecting rod, the eccentric link, and the variable link are disposed between a pair of balance weights.

8. The variable compression ratio apparatus of claim 1, further comprising an actuator connected to the control shaft and adapted to rotate the control shaft.

9. A variable compression ratio apparatus for an engine receiving combustion force of an air-fuel mixture from a piston and a rotating crankshaft, and which changes compression ratio of the air-fuel mixture, the variable compression ratio apparatus comprising:

a connecting rod including one end formed with a mounting hole and an other end rotatably connected to the crankshaft to transmit the combustion force of the air-fuel mixture received from the piston to the crankshaft;

a control shaft rotating according to a driving condition of the engine;

a variable gear link pivoting with respect to a fixed shaft by the rotation of the control shaft;

an eccentric link including one end connected to an eccentric bearing concentrically and rotatably mounted in the mounting hole;

a variable link connecting the other end of the eccentric link to the variable gear link and rotating the eccentric link with respect to the eccentric bearing by pivoting movement of the variable gear link;

a piston pin eccentrically inserted in the eccentric bearing and mounted in the piston to rotatably connect the eccentric link and the connecting rod to the piston; and a guide bar, together with the connecting rod, limiting horizontal movement of the eccentric link.

10. The variable compression ratio apparatus of claim 9, wherein the variable gear link has fan shape, and the fixed shaft is positioned near a vertex of the fan shape.

11. The variable compression ratio apparatus of claim 10, wherein a first gear teeth is formed at an exterior circumference of the variable gear link, and a second gear teeth engaging with the first gear teeth is formed at an exterior circumference of the control shaft.

12. The variable compression ratio apparatus of claim 9, wherein the variable gear link is formed with a variable link slot, and the other end of the variable link is inserted in the variable link slot such that horizontal movement of the variable link is limited.

13. The variable compression ratio apparatus of claim 9, wherein the guide bar is coupled to a lower end of a cylinder block liner or a bulk portion.

14. The variable compression ratio apparatus of claim 13, wherein the guide bar is disposed at an opposite side of the connecting rod with reference to the eccentric link.

15. The variable compression ratio apparatus of claim 13, wherein a plurality of balance weights for reducing rotational vibration is mounted at the crankshaft, and the connecting rod, the eccentric link, and the variable link are disposed between a pair of balance weights.

16. The variable compression ratio apparatus of claim 9, wherein the eccentric bearing is integrally formed to the eccentric link.

17. The variable compression ratio apparatus of claim 9, further comprising an actuator adapted to rotate the control shaft according to a driving condition of the engine.

* * * * *